US012168931B2

(12) United States Patent
Wang et al.

(10) Patent No.: US 12,168,931 B2
(45) Date of Patent: Dec. 17, 2024

(54) MINING METHOD WITHOUT COAL PILLARS WITH ROOF-CUTTING AND ROADWAY RETAINING

(71) Applicant: China University Of Mining And Technology, Beijing, Beijing (CN)

(72) Inventors: Jiong Wang, Beijing (CN); Wenfei Li, Beijing (CN); Zimin Ma, Beijing (CN); Guangyuan Yu, Beijing (CN)

(73) Assignee: China University Of Mining and Technology, Beijing, Beijing (CN)

( * ) Notice: Subject to any disclaimer, the term of this patent is extended or adjusted under 35 U.S.C. 154(b) by 128 days.

(21) Appl. No.: 17/922,128

(22) PCT Filed: Apr. 30, 2021

(86) PCT No.: PCT/CN2021/091478
§ 371 (c)(1),
(2) Date: May 9, 2023

(87) PCT Pub. No.: WO2021/219131
PCT Pub. Date: Nov. 4, 2021

(65) Prior Publication Data

US 2023/0258083 A1 Aug. 17, 2023

(30) Foreign Application Priority Data

Apr. 30, 2020 (CN) ..... 202010367096.0

(51) Int. Cl.
*E21C 41/00* (2006.01)
*E21C 41/18* (2006.01)
(Continued)

(52) U.S. Cl.
CPC ..... *E21C 41/18* (2013.01); *E21F 1/00* (2013.01); *E21F 16/00* (2013.01)

(58) Field of Classification Search
CPC .. E21C 41/18; E21F 1/006; E21F 1/00; E21F 16/00; E21D 9/01
See application file for complete search history.

(56) References Cited

U.S. PATENT DOCUMENTS 2,859,682 A * 11/1958 Joy ..... E21F 1/006 454/168

FOREIGN PATENT DOCUMENTS

CN 105275487 A 1/2016
CN 107725097 A 2/2018
(Continued)

*Primary Examiner* — Carib A Oquendo
(74) *Attorney, Agent, or Firm* — Wong Meyer Smith & McConnell

(57) ABSTRACT

A mining method is provided without coal pillars with roof-cutting and roadway retaining. This includes, comprising: constructing a gas drainage roadway and eliminating outbursts in a working face transport gate area and track gate area on opposite sides of a first mining working face; constructing various components with an air return roadway. Another end is communicated with the gas drainage roadway by the first process roadway, one end of the working face track gate is communicated with the air return roadway, the other end is communicated with the gas drainage roadway. A ventilation system is formed. This makes full use of the existing gas drainage roadway to meet the roadway layout requirements using the 110 construction method, increasing the use function of the roadway and increasing the reuse rate of the roadway, reducing the roadway engineering quantity before production, shortening the construction period and reduce the cost.

6 Claims, 2 Drawing Sheets

(51) Int. Cl.
*E21F 1/00* (2006.01)
*E21F 16/00* (2006.01)

(56) References Cited

FOREIGN PATENT DOCUMENTS

| | | | | |
|---|---|---|---|---|
| CN | 109083674 | | * | 12/2018 |
| CN | 111622795 | A | | 9/2020 |
| CN | 111636870 | A | | 9/2020 |
| CN | 111828083 | A | | 10/2020 |
| SU | 1696739 | A1 | | 12/1991 |

* cited by examiner

MINING METHOD WITHOUT COAL PILLARS WITH ROOF-CUTTING AND ROADWAY RETAINING

This disclosure claims the priority of Chinese patent application No. 202010367096.0 filed on Apr. 30, 2020 with the Patent Office of the National Intellectual Property Administration of the People's Republic of China, titled "mining method without coal pillars with roof-cutting and roadway retaining", of which the entire contents are incorporated herein by reference.

FIELD

The present disclosure relates to the technical field of coal mining, and in particular, to a mining method without coal pillars with roof-cutting and roadway retaining.

BACKGROUND

With the continuous increasing of the mining depth of coal resources, the gas content and gas pressure of the coal seam continue to increase, and the danger of coal and gas outburst is becoming more and more serious. For coal seams with the danger of coal and gas outburst, arranging gas drainage roadways in the top (or bottom) slate roadways, and pre-draining coal seam gas in coal roadways by construction through-layer drilling is one of the main regional outburst prevention measures.

The 110 construction method without coal pillars with roof-cutting and pressure relief forming a roadway is an advanced mining technology without coal pillars and one of the key technologies to maintain the sustainable development of China's coal resources, as well as an important guarantee for solving gas and power disasters, improving coal recovery rate, reducing roadway excavation rate, and realizing scientific mining. The 110 construction method without coal pillars refers to a technology, wherein after reinforcing and supporting the mining roadway, directional pre-split blasting is carried out on the side of the roadway where the goaf will be formed, the roof is cut according to the design position, after the cutting is completed, with the mining of the coal seam in the working face, under the action of the mine pressure, the roof of the mined-out area collapses along the pre-split cutting seam to form a roadway, using part of the original roadway space and support to automatically form a new roadway, as the mining roadway of the next working face. The 110 construction method does not leave a section of coal pillars, which improves the resource recovery rate, while one less mining roadway is excavated in each working face, which reduces the excavation rate of 10,000 tons of coal mines.

However, in the prior art, in order to meet the requirement of using the 110 construction method to keep two roadways, it is necessary to excavate four parallel roadways in the early stage of mining to form three working faces, so as to meet the roadway layout requirements and related safety measures, which prolongs the mine construction time, increases the initial investment funds. According to the current mining method, it is difficult to design only one mining face in the early stage of mining to meet the requirements of using the 110 construction method to retain two roadways.

SUMMARY

In order to solve the above technical problems, an embodiment of the disclosure provides a mining method without coal pillars with roof-cutting and roadway retaining, comprising:

constructing a gas drainage roadway and eliminating outbursts in a working face transport gate area and a working face track gate area on opposite sides of a first mining working face;

constructing the working face track gate, the working face transport gate, a first process roadway and a second process roadway, wherein one end of the working face track gate is communicated with an air inlet roadway, the other end is communicated with the gas drainage roadway by the first process roadway, wherein one end of the working face track gate is communicated with the air inlet roadway, the other end is communicated with the gas drainage roadway by the second process roadway;

constructing a roof-cutting seam blasting ahead of the coal mining face in the working face track gate and the working face transport gate, arranging a blast holes the stoping side corner line area to form a pre-split cutting seam; and stoping the working face, forming an roadway retaining section in the working face track gate and the working face transport gate, the roadway retaining section is communicated with the gas drainage roadway by the first process roadway and the second process roadway, forming a complete ventilation system.

Further, the gas drainage roadway comprises a gas drainage air inlet roadway, a short roadway and a gas drainage air return roadway connected in sequence, wherein the first process roadway is communicated with the gas drainage air return roadway, the first process roadway is communicated with the gas drainage return air inlet roadway.

Further, forming a first roof-cutting and roadway retaining section by a part of the working face track gate located in the goaf, and forming a second roof-cutting and roadway retaining section by a part of the working face transport gate located in the goaf during the stoping process of the working face, wherein a ventilation line of the ventilation system is:

feeding an air through the gas drainage air inlet roadway, the working face transport gate and the working face track gate, and the air is returned through the gas drainage air return roadway;

diverting a part of the air feeding through the working face transport gate to the coal mining working face and merging with the air feeding through the working face track gate, then passing through the first top cutting and roadway retaining section and the first process roadway in turn, entering the gas drainage air return roadway to form a return air;

merging with the air feeding of the gas drainage air inlet roadway by the second process roadway after the other part of the air feeding through the working face transport gate is diverted to the second roof-cutting and roadway retaining section, the part enters the gas drainage air return roadway to form return air.

Further, a first regulating damper is arranged inside an end of the working face track gate communicated with the first process roadway; a second regulating damper is arranged inside an end of the working face transport gate communicated with the second process roadway.

Further, the roof of the roadway is reinforced and supported during the advancement of the working face track gate and the working face transport gate.

Further, a temporary support device and a gangue retaining device in the roadway are provided along the roadway retaining section during the stoping process of the working face.

Compared with the prior art, the technical solutions of the embodiments of the present disclosure has the following advantages: in the coal and gas outburst mine, the mining of the first working face makes full use of the existing gas drainage roadway, so as to meet the roadway layout requirements and related safety measures of using the 110 construction method, increasing the using function of the roadway and the reusing rate, reducing the roadway engineering quantity before production, shortening the construction period, and reducing the cost. Finally, two roadways are reserved for the opposite working faces on both sides to be reused during mining.

BRIEF DESCRIPTION OF THE DRAWINGS

The accompanying drawings, which are incorporated in and constitute a part of this specification, illustrate embodiments consistent with the disclosure and together with the description serve to explain the principles of the disclosure.

In order to illustrate the embodiments of the present disclosure or the technical solutions in the prior art more clearly, the following briefly introduces the accompanying drawings that need to be used in the description of the embodiments or the prior art. Obviously, on the premise of no creative labor, other drawings can also be obtained from these drawings.

Figure 1:
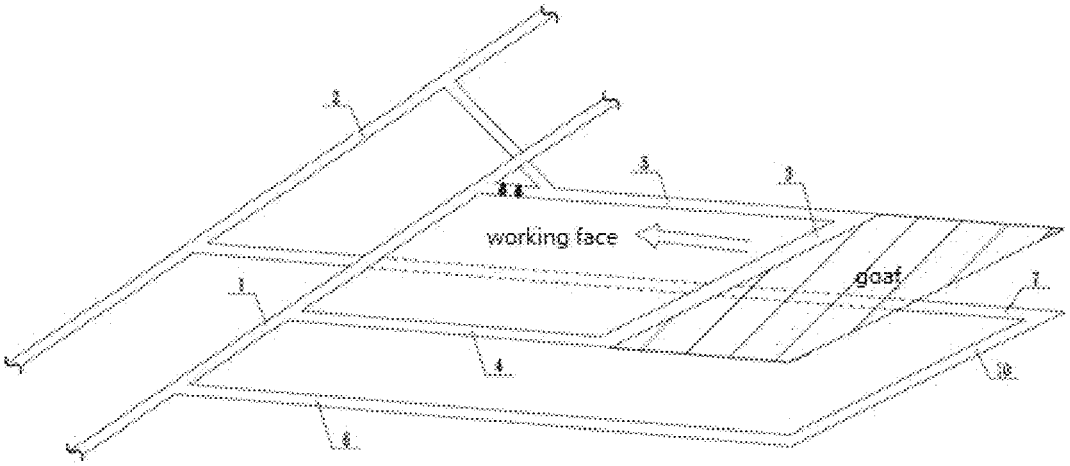
Fig. 1 (Prior Art)
FIG. 1 is a schematic diagram of the roadway layout during the stoping process of the first working face of the coal and gas outburst coal seam in the prior art.

In the Picture:

1. Air inlet main roadway;
2. Air return main roadway;
3. Coal mining working face;
4. Working face transport gate;
5. Working face track gate;
6. Gas drainage air inlet roadway;
7. Gas drainage air return roadway;
8. First process roadway;
9. Second process roadway;
10. Short roadway;
11. First roof-cutting and roadway retaining section;
12. Second roof-cutting and roadway retaining section;
13. Inclined roadway;
14. First regulating damper;
15. Second regulating damper;
16. Third regulating damper;
17. Fourth regulating damper.

DETAILED DESCRIPTION

In order to make those skilled in the art better understand the solutions of the present disclosure, the technical solutions in the embodiments of the present disclosure will be clearly and completely described below with reference to the accompanying drawings in the embodiments of the present disclosure. Obviously, the described embodiments are only part of the embodiments of the present disclosure, but not all of the embodiments. Based on the embodiments in the present disclosure, all other embodiments obtained by those of ordinary skill in the art without creative work shall fall within the protection scope of the present disclosure.

It should be noted that the terms "first", "second", etc. in the description and claims of the present disclosure and the above drawings are used to distinguish similar objects, and are not necessarily used to describe a specific sequence or sequence. It is to be understood that the data so used are interchangeable under appropriate circumstances for the embodiments of the disclosure described herein. Furthermore, the terms "comprising" and "having" and any variations thereof, are intended to cover non-exclusive inclusion, for example, a process, method, system, product or device comprising a series of steps or units is not necessarily limited to those expressly listed Rather, those steps or units may comprise other steps or units not expressly listed or inherent to these processes, methods, products or devices.

In this disclosure, the orientation or positional relationship indicated by the terms "upper", "lower", "inner", "middle", "outer", "front", "rear", etc. is based on the orientation or position shown in the drawings relation. These terms are primarily used to better describe the present disclosure and its embodiments, and are not intended to limit the fact that the indicated device, element, or component must have a particular orientation, or be constructed and operated in a particular orientation.

In addition, some of the above-mentioned terms may be used to express other meanings besides orientation or positional relationship. For example, the term "on" may also be used to express a certain attachment or connection relationship in some cases. For those of ordinary skill in the art, the specific meanings of these terms in the present disclosure can be understood according to specific situations.

Furthermore, the terms "arranged", "connected", "fixed" should be construed broadly. For example, "connection" may be a fixed connection, a detachable connection, or a unitary construction; it may be a mechanical connection, or an electrical connection; it may be a direct connection, or an indirect connection through an intermediary, or two devices, elements or internal connectivity between components. For those of ordinary skilled in the art, the specific meanings of the above terms in this disclosure can be understood according to specific situations.

It should be noted that the embodiments in the present disclosure and the features of the embodiments may be combined with each other in the case of no conflict. The present disclosure will be described in detail below with reference to the accompanying drawings and in conjunction with the embodiments.

As shown in FIG. 1, a schematic diagram of the roadway layout during the mining process of the coal and gas outburst mine using the 121 construction method in the prior art is shown. As shown, each working face is correspondingly provided with a working face transport gate 4, a working face track gate 5 and a coal mining working face 3, the working face transport gate 4 of each working face is communicated with the air inlet main roadway 1, the working face track gate 5 of each working face is communicated with the air return main roadway 2. A gas drainage air inlet roadway 6 and a gas drainage air return roadway 7 for gas drainage are also provided, the gas drainage air inlet roadway 6 and the gas drainage air return roadways 7 communicates with each other by a short roadway 10 to form a ventilation circuit. In the current structure, coal pillars need to be left, resulting in a lot of waste of resources. In addition, each working face needs to be excavated two gate roadways and two rock roadways for gas drainage, resulting in serious mining imbalance in the mine.

In order to make full use of the advanced mining technology, it is necessary to use the 110 construction method for mining. However, when two roadways need to be left using the 110 construction method, it is necessary to excavate four gate roadways and four gas extraction rock roadways to form three working faces to meet the roadway layout requirements and related safety measures using the 110 construction method, prolonging the mine construction time and increasing the initial investment funds. According to the current mining method, only one mining face is designed in the early stage of mining. It is difficult to meet the requirements of the 110 construction method.

Figure 2:
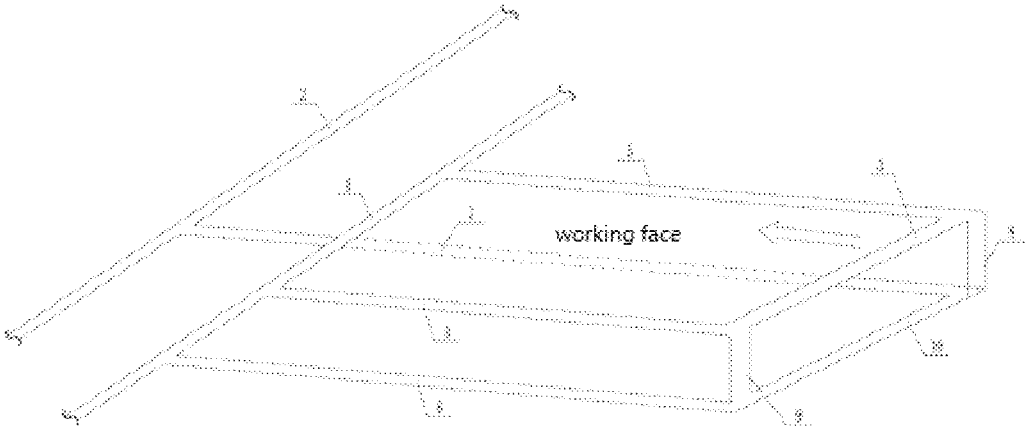
FIG. 2 is a schematic diagram of the roadway layout of the first working face of a coal and gas outburst coal seam before stoping in an embodiment of the present disclosure.
Figure 3:
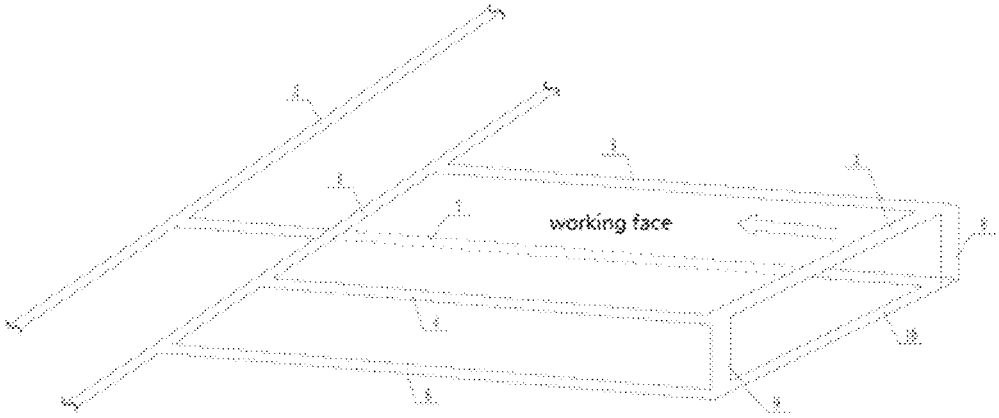
FIG. 3 is a schematic diagram of the roadway layout of the first working face of a coal and gas outburst coal seam during the stoping process in an embodiment of the present disclosure.
Figure 4:
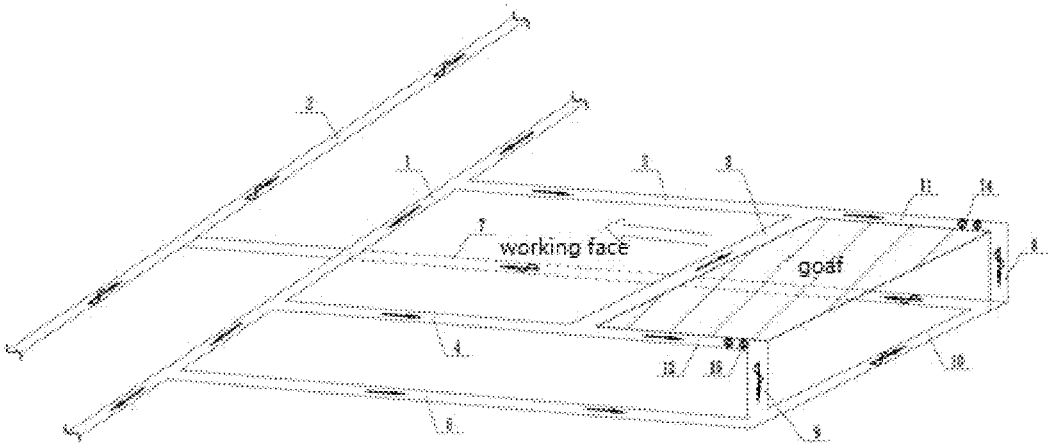
FIG. 4 is a schematic diagram of a ventilation circuit of the first working face of a coal and gas outburst coal seam during the stoping process in an embodiment of the disclosure.

Based on this, as shown in FIGS. 2-4, embodiments of the present disclosure provide a mining method without coal pillars with roof-cutting and roadway retaining, specifically a mining method of retaining two roadways in the first working face of a coal and gas outburst coal seam. The method comprises the following steps:

Step 1: constructing gas drainage roadways and eliminating outbursts in a working face transport gate area and a working face track gate area on opposite sides of the first mining working face; as shown in FIG. 2, the gas drainage roadway comprises a gas drainage air inlet roadway 6, a short roadway and a gas drainage air return roadway 7 connected in sequence, wherein the gas extraction air inlet roadway 6 is communicated with the air inlet main roadway 1, the gas extraction air return roadway 7 is communicated with the air return main roadway 2. During the process of gas extraction and outburst elimination in the two gate areas of the first mining working face, the ventilation route in the gas extraction roadway is: fresh air flow→inlet air main roadway 1→gas extraction air inlet roadway 6→short roadway 10→gas extraction air return roadway 7→air return main roadway 2.

Step 2: after the gas drainage and outburst elimination are completed in the two gate areas of the first working face, as shown in FIG. 2, the working face track gate 5, the working face transport gate 4, the first process roadway 8 and the second process roadway 9 are constructed, two sides of the working face track gate 5 and the working face transport gate 4 located on opposite sides of the working face are constructed, wherein one end of the working face track gate 5 is communicated with the air inlet main roadway 1, the other end is communicated with the gas drainage main roadway by the first process roadway 8. One end of the working face track gate 5 is communicated with the air inlet main roadway 1, the other end is communicated with the gas drainage roadway by the second process roadway 9. Preferably, the first process roadway 8 is communicated with the gas drainage air return roadway 7, the second process roadway 9 is communicated with the gas drainage air inlet roadway 6.

Step 3: constructing a roof-cutting seam blasting ahead of the coal mining face 3 in the working face track gate 5 and the working face transport gate 4, the blast hole is arranged in the corner line area of the stoping side roadway to form a pre-split cutting seam.

Step 4: stoping the working face, forming a roadway retaining section in the working face track gate 5 and the working face transport gate 4, the roadway retaining section communicates with the gas drainage roadway by the first process roadway 8 and the second process roadway 9, forming a complete ventilation system. After the stoping of the first working face is completed, the reserved roadway retaining section can be used for the stoping of the adjacent working face.

Specifically, in step 4, as shown in FIG. 3, during the stoping process of the working face, the part of the working face track gate 5 located in the goaf forms a first roof-cutting and roadway retaining section 11, the part of the working face transport gate 4 located in the goaf forms a second roof-cutting and roadway retaining section 12. As shown in FIG. 4, the ventilation lines of the ventilation system formed by each roadway are:

The air is fed through the gas drainage air inlet 6, the working face transporting gate 4 and the working face track gate 5, and the air is returned through the gas drainage air return roadway 7; a part of the air feeding through the working face transporting gate 4 is diverted to the coal mining working face 3 and then merges with the air feeding through the working face track gate 5, after that passes through the first roof-cutting and roadway retaining section 11 and the first process roadway 8 in turn, entering the gas drainage air return roadway 7 to form return air; after diverting to the second roof-cutting and roadway retaining section 12, the other part of the air feeding through the working face transport gate 4 merges with the air feeding through the gas drainage air inlet roadway 6 by the second process roadway 9, then enters the gas drainage air return roadway 7 to form return air. That is, it will comprise at least the following ventilation sub-circuits:

(1) Fresh air flow→air inlet main roadway 1→working face track gate 5→first roof-cutting and roadway retaining section 11→gas drainage air return roadway 7→air return main roadway 2;

(2) Fresh air flow→air inlet main roadway 1→working face transport gate 4→stoping working face→first roof-cutting and roadway retaining section 11→gas drainage air return roadway 7→air return main roadway 2;

(3) Fresh air flow→air inlet main roadway 1→stoping the working face transport gate 4→second roof-cutting and roadway retaining section 12→gas drainage air inlet roadway 6→short roadway 10→gas drainage air return roadway 7→air return main roadway 2;

(4) Fresh air flow→air inlet main roadway 1→gas drainage air inlet roadway 6→short roadway 10→gas drainage air return roadway 7→air return roadway 2.

In the above ventilation system, the ventilation of the first and second roof-cutting and roadway retaining sections is achieved, and there is no need to prepare the roadway for the ventilation of the roadway-retention section in advance, and it is also not necessary to seal the roadway-retention section, reducing the labor intensity of workers; after stoping, the first and second roof-cutting and roadway retaining sections can be reused directly to speed up the progress of the roadway-retention project. In addition, a monitoring instrument for surrounding rock changes can be installed in the roadway retaining section, personnel can enter and exit at any time, which is convenient for real-time monitoring of changes in the surrounding rock of the roadway. The ventilation of the road retaining section enables the toxic and harmful gases in the goaf and adjacent coal seams to be discharged from the ground with the wind flow, no longer accumulate, reducing safety accidents such as personnel poisoning and gas explosion. In addition, while the first working face is being stoped, it is possible to make overall arrangements for the construction of the next working face for gas drainage and gas treatment in the adjacent coal seam, so as to reduce the time of the gas treatment project and solve the problem of mining replacement difficulties.

In order to realize the above ventilation line, as shown in FIG. 4, a first regulating damper 14 is provided inside an end of the working face track gate 5 communicated with the first process roadway 8 (that is, the first roof-cutting and roadway retaining section 11 after stoping), a second regulating damper 15 is provided inside an end of the working face transport gate 4 communicated with the second process roadway 9 (that is, the second roof-cutting and roadway retaining section 12 after stoping). The air intake volume entering the first process roadway 8 is controlled by the first regulating damper 14, the air intake volume diverting to the second roof-cutting and roadway retaining section 12 at the coal mining working face 3 is controlled by the second regulating damper 15.

In addition, after the first and second roof-cutting and roadway retaining sections are retained, they can be used for the gate during the stoping of adjacent working faces, on the other hand can be arranged in the road retaining section for construction of gas drainage boreholes and adjacent coal seam gas control works in the next mining face. In the reuse stage of the roadway retaining section, the ventilation direction needs to be adjusted according to the actual needs. Therefore, an inclined roadway 13 is provided in the roadway arrangement shown in FIG. 5, one end of the working face transport gate 4, the working face track gate 5 and the gas drainage air inlet roadway 6 are all communicated with the air inlet main roadway 1. The working face track gate 5 communicates with the air return main roadway 2 by the inclined roadway 13. A third regulating damper 16 is provided in the working face track gate 5, located between the connection of the working face track gate 5 and the air inlet main roadway 1 and the connection of the working face track gate 5 and the inclined roadway 13. A fourth regulating damper 17 arranged in the inclined roadway 13. The communication of the working face track gate 5 and the air inlet main roadway 1 can be opened or closed and the air volume can be adjusted by means of the third regulating damper 16, the communication of the working face track gate 5 and the air return main roadway 2 can be opened or closed and the air volume can be adjusted by means of the fourth regulating damper. By the third regulating damper 16 and the fourth regulating damper 17, the working face track gate can be switched between the two functions of air intake and air return, so as to realize the switching of different ventilation modes. For example, when stoping the working face shown in FIG. 4, the working face track gate 5 is used for air intake. During the process of stoping the next working face, or when the roadway is reserved for gas drainage, the working face track gate 5 can be used for air returning by adjusting the third regulating damper 16 and the fourth regulating damper 17 (after completing the stoping of the working face, the working face track gate 5 will all become the first roof-cutting and roadway retaining section. In the same way, the working face transport gate can realize the switching between the air intaking and the air returning by providing the inclined roadway and adjusting the regulating damper in the same way, which will not be repeated here.

Figure 5:
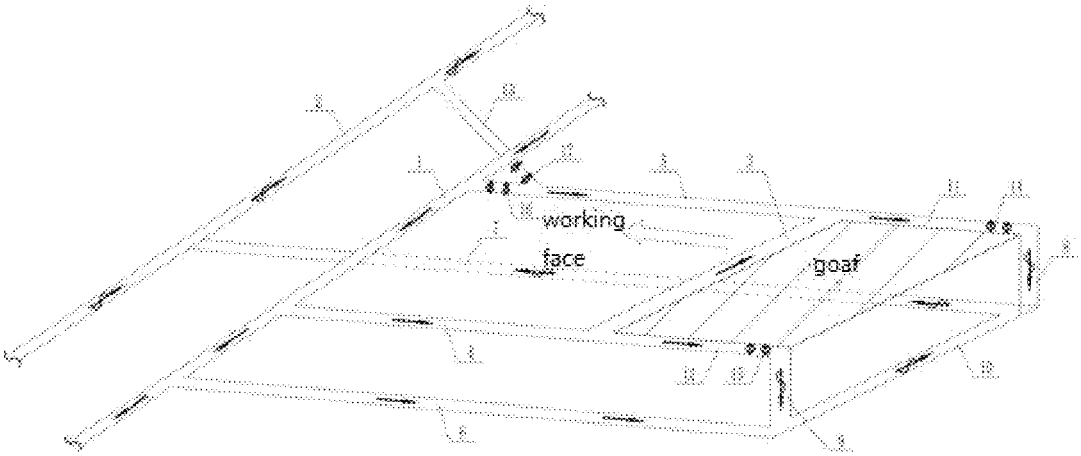
FIG. 5 is a schematic diagram of the ventilation circuit of the first working face of a coal and gas outburst coal seam during the stoping process in an embodiment of the present disclosure.

Preferably, the first regulating damper 14, the second regulating damper 15, the third regulating damper 16 and the fourth regulating damper 17 shown in FIGS. 4 and 5 are all two-way regulating dampers, and electronic dampers can be used for remote control.

In the above embodiment, in step 3, by blasting the cutting seam on the roof of the roadway, it is more conducive for the collapse of the rock formation in the goaf, so that the mining space can be better filled after the rock formation after the cutting seam collapses, and make the roof of the road retaining form a short arm beam structure in the lateral direction, avoiding the formation of a long overhanging roof in the goaf, improving the surrounding rock stress of gob-side entry retention, that is, reducing the larger additional load to the entry retention.

In some embodiments, the roof of the roadway is reinforced and supported during the digging of the working face track gate and the working face transport gate. Since the roof of the roadway retaining section will be subject to multiple disturbances during the advancement of the working face and the multiplexing of the roadway retaining, various cracks are easily generated, resulting in a decrease in the strength of the roof and affecting the stability of the roadway retaining section. Preferably, the roof of the roadway is reinforced and supported before the stoping (for example, during the digging of the working face track gate and the working face transport gate), including but not limited to the use of constant-resistance anchor cables and grouting anchor cables to reinforce the roof. Before the second reuse of the roadway retaining roadway, the grouting anchor cable is used to inject grouting into the cracked roof to improve the strength of the roof. In addition, during the stoping process of the working face, a temporary support device and a gangue retaining device are provided in the roadway retaining section.

The corresponding arrangement position and connection relationship of each unmentioned structure in this disclosure, the mutual timing and control parameters of each unmentioned step can refer to similar devices and methods in the prior art, the connection relationship of each unmentioned structure, the operation and working principle are known to those of ordinary skilled in the art and will not be described in detail here.

Some embodiments in this specification are described in a progressive manner, and each embodiment focuses on the differences from other embodiments, and the same and similar parts between the various embodiments can be referred to each other.

The above are only specific embodiments of the present disclosure, so that those skilled in the art can understand or implement the present disclosure. Various modifications to these embodiments will be readily apparent to those skilled in the art, and the generic principles defined herein may be implemented in other embodiments without departing from the spirit or scope of the disclosure. Therefore, the present disclosure is not intended to be limited to the embodiments shown herein, but is to be accorded the widest scope consistent with the principles and novel features claimed herein.

What is claimed is:

1. A mining method without coal pillars with roof-cutting and roadway retaining, comprising:

constructing a gas drainage roadway and eliminating outbursts in a working face transport gate area and a working face track gate area on opposite sides of a first mining working face;

constructing the working face track gate, the working face transport gate, a first process roadway and a second process roadway, wherein one end of the working face track gate is communicated with an air inlet main roadway, the other end is communicated with the gas drainage roadway by the first process roadway, wherein one end of the working face transport gate is communicated with the air inlet main roadway, the other end is communicated with the gas drainage roadway by the second process roadway;

constructing a roof-cutting seam blasting ahead of a coal mining face in the working face track gate and the working face transport gate, arranging a blast hole in a stoping side corner line area to form a pre-split cutting seam; and stoping the working face, forming an roadway retaining section in the working face track gate and the working face transport gate, wherein the roadway retaining section is communicated with the gas drainage roadway by the first process roadway and the second process roadway, forming a complete ventilation system.

2. The mining method of claim 1, wherein the gas drainage roadway comprises a gas drainage air inlet roadway, a short roadway and a gas drainage air return roadway connected in sequence, wherein the first process roadway is communicated with the gas drainage air return roadway, the first process roadway is communicated with the gas drainage return air inlet roadway.

3. The mining method of claim 2, further comprising:

forming a first roof-cutting and roadway retaining section by a part of the working face track gate located in a goaf, and forming a second roof-cutting and roadway retaining section by a part of the working face transport gate located in the goaf during the stoping process of the working face, wherein a ventilation line of a ventilation system is:

feeding an air through the gas drainage air inlet roadway, the working face transport gate and the working face track gate, and returning the air through the gas drainage air return roadway;

diverting a part of the air feeding through the working face transport gate to the coal mining working face and merging with the air feeding through the working face track gate, then passing through the first roof-cutting and roadway retaining section and the first process roadway in turn, entering the gas drainage air return roadway to form a return air;

merging with the air feeding of the gas drainage air inlet roadway by the second process roadway after the other part of the air feeding through the working face transport gate is diverted to the second roof-cutting and roadway retaining section, then entering the gas drainage air return roadway to form the return air.

4. The mining method of claim 1, wherein a first regulating damper is arranged inside an end of the working face track gate communicated with the first process roadway; a second regulating damper is arranged inside an end of the working face transport gate communicated with the second process roadway.

5. The mining method of claim 1, wherein the roof of the roadway is reinforced and supported during the advancement of the working face track gate and the working face transport gate.

6. The mining method of claim 1, wherein a temporary support device and a gangue retaining device in the roadway are provided along the roadway retaining section during the stoping process of the working face.

* * * * *